US008997390B1

(12) United States Patent
Heizer

(10) Patent No.: US 8,997,390 B1
(45) **Date of Patent: *Apr. 7, 2015**

(54) TRIGGER MECHANISM WITH CAM SURFACE SEAR

(71) Applicant: Charles K. Heizer, St. Louis, MO (US)

(72) Inventor: Charles K. Heizer, St. Louis, MO (US)

(73) Assignee: Heizer Defense, LLC, Pevely, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/970,300

(22) Filed: Aug. 19, 2013

(51) Int. Cl.

| | |
|---|---|
| ***F41A 3/58*** | (2006.01) |
| ***F41A 19/18*** | (2006.01) |
| ***F41A 19/22*** | (2006.01) |
| ***F41A 19/00*** | (2006.01) |

(52) U.S. Cl.
CPC .. *F41A 19/00* (2013.01); *F41A 3/58* (2013.01)

(58) Field of Classification Search
USPC ..... 42/2, 8, 69.01; 89/1.41, 27.11
See application file for complete search history.

(56) References Cited

U.S. PATENT DOCUMENTS

| | | | | |
|---|---|---|---|---|
| 4,026,056 | A * | 5/1977 | Roman | 42/69.01 |
| 4,109,402 | A | 8/1978 | Guardamino | |
| 4,384,422 | A | 5/1983 | Röh | |
| 4,400,900 | A | 8/1983 | Hillberg | |
| 4,407,085 | A | 10/1983 | Hillberg | |
| 4,512,100 | A | 4/1985 | Dheur | |
| 4,516,466 | A | 5/1985 | Jennie | |
| 4,577,429 | A | 3/1986 | Waiser | |
| 4,722,148 | A | 2/1988 | Walker | |
| 4,819,358 | A | 4/1989 | Eder | |
| 5,050,480 | A | 9/1991 | Knight, Jr. | |
| 5,822,903 | A | 10/1998 | Davis, Sr. | |
| 7,086,191 | B2 | 8/2006 | Orr | |
| 7,165,352 | B2 | 1/2007 | Langlotz | |
| 7,331,136 | B2 | 2/2008 | Geissele | |
| 7,500,327 | B2 | 3/2009 | Bubits | |
| 7,661,220 | B2 | 2/2010 | Crandall | |
| 8,495,831 | B1 * | 7/2013 | Kohout | 42/8 |
| 2006/0048426 | A1 * | 3/2006 | Crandall | 42/69.01 |
| 2009/0044437 | A1 | 2/2009 | Zajk | |
| 2011/0072704 | A1 * | 3/2011 | Teach et al. | 42/8 |
| 2013/0104436 | A1 * | 5/2013 | Heizer | 42/69.01 |

OTHER PUBLICATIONS

PCT International Searching Authority (ISA), International Search Report for PCT/US2012/062342 (Pub. No. WO 2013/115863), Jul. 29, 2013, ISA/US.

(Continued)

*Primary Examiner* — Bret Hayes
(74) *Attorney, Agent, or Firm* — CreatiVenture Law, LLC; Dennis JM Donahue, III

(57) ABSTRACT

A trigger mechanism has a hammer, a hammer spring, a trigger pull, a trigger spring, a pivotal linkage between the trigger pull and a sear which has a cam surface and a guide. The hammer has striking and bearing ends and a pivot point between the ends. The hammers' bearing end rides up on the cam surface as it moves between different positions relative to the guide. The hammer pivots around the pivot point and the striking end is moved between the hammer's seated and cocked positions as the cam surface moves between its positions. The hammer spring has opposite ends connected to the firearm's frame and the hammer, respectively, which provides a hammer spring force. The hammer spring biases the striking end of the hammer to the seated, striking position and the movement of the hammer to its rearward position is performed against the hammer spring force.

20 Claims, 3 Drawing Sheets

(56) References Cited

OTHER PUBLICATIONS

Executed and Filed Complaint for Declaration of Correction of Inventorship and Transfer of Rights for Patent No. 8,495,831, *Heizer Aerospace Inc. and Heizer Defense, LLC et al.* Plaintiffs v. *Doubletap Defense LLC*, Defendants, Civil Action No. 4:13-cv-01784 US District Court, Eastern District of Missouri, Sep. 10, 2013 (21 pages).

* cited by examiner

TRIGGER MECHANISM WITH CAM SURFACE SEAR

CROSS-REFERENCE TO RELATED APPLICATIONS

This application is a continuation of U.S. patent application Ser. No. 13/828,722 filed on Mar. 14, 2013 which is hereby incorporated by reference and which claims priority to U.S. patent application Ser. No. 13/333,513 filed on Dec. 21, 2011, now issued as U.S. Pat. No. 8,495,831 and which claims priority to U.S. Provisional Patent Application No. 61/426,458 filed on Dec. 22, 2010. This application also claims the benefit of priority from U.S. patent application Ser. No. 13/662,506 on Oct. 28, 2012 which claims priority from U.S. Provisional Patent Application Ser. No. 61/552,499 filed on Oct. 28, 2011, both of which are hereby incorporated by reference.

STATEMENT REGARDING FEDERALLY SPONSORED RESEARCH

Not Applicable.

APPENDIX

Not Applicable.

BACKGROUND OF THE INVENTION

1. Field of the Invention

The present invention relates to the trigger mechanism for a firearm, and more particularly to a trigger mechanism that has a sear with a cam surface.

2. Related Art

There are a number of trigger mechanisms that have been used for firearms, including trigger mechanisms that are particularly designed for single-barrel pistols and multi-barrel pistols. In particular, there are double-action trigger mechanisms that have been designed for Derringer-type pistols. Additionally, there are existing trigger mechanisms which can maintain a constant pressure throughout a trigger pull and can allow for an adjustment of the pressure which is required for the trigger pull, i.e, the trigger pull weight. However, none of these known trigger mechanisms provide an operation that is as smooth and efficient as the trigger mechanism provided in the present invention. In particular, none of these known trigger mechanisms combine the mechanical advantage of a cam surface sear that works in combination with the trigger pull, linkage, hammer and hammer spring to control the trigger pull force as the hammer is forced to rotate from its striking position (i.e., seated position) to its rearward position (i.e., cocked position).

Small, light weight pistols, such as those made by Derringer, have been available for many years. While such pistols included double barrel pistols, they were not designed to provide a two shot capability (a so-called "double tap" shooting technique capability) without taking action other than by making successive trigger pulls. Thus, such pistols typically required some additional action by the shooter, such as the flipping of a lever, manually cocking the hammer, or the use of two triggers, in order to provide two shot capability. Even then, once the pistols of the prior art had been discharged they were not designed to be reloaded quickly, easily, or conveniently.

The prior art also included such single shot, small, light weight pistols as the "Liberator" which was quite inexpensive to manufacture and which included space within its butt where additional rounds of ammunition could be stored. Once again, however, the design of the Liberator pistol did not permit reloading to be quick, easy, or convenient. Further, the design of the Liberator pistol was such that it included numerous parts which were not "smoothly" integrated whereby that pistol could be quickly and reliably extricated from a pocket or other concealed location without a likelihood of some portion of the pistol (e.g., an external hammer) catching on the user's clothing, etc., which feature is especially important in a tactical situation.

SUMMARY OF THE INVENTION

The present invention is for a trigger mechanism that has a trigger pull, a trigger spring, a pivotal linkage between the trigger pull and a sear which has a cam surface and a guide, a hammer, and a hammer spring. The trigger spring preferably has one end positioned against the firearm frame and a second end extending away from the firearm frame to force the trigger pull out away from the frame. The hammer has a striking end, a bearing end and a pivot point between the striking and bearing ends. The bearing end of the hammer rides up on the cam surface as it moves between different positions relative to the guide. The hammer is pivoted around the pivot point and the striking end is moved from the hammer's seated position to its cocked position as the cam surface moves between its positions. The hammer spring has one end connected to the firearm's frame and another end connected to the hammer to provide a hammer spring force. The hammer spring biases the striking end of the hammer to the seated, striking position and the movement of said hammer from the seated position to its rearward position is performed against the hammer spring force.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings. The drawings constitute a part of this specification and include exemplary embodiments of the invention, which may be embodied in various forms. It is to be understood that in some instances, various aspects of the invention may be shown exaggerated or enlarged to facilitate an understanding of the invention; therefore the drawings are not necessarily to scale. In addition, in the embodiments depicted herein, like reference numerals in the various drawings refer to identical or near identical structural elements.

DETAILED DESCRIPTION OF THE PREFERRED EMBODIMENTS

The following description of the preferred embodiment(s) is merely exemplary in nature and is in no way intended to limit the invention, its application, or uses.

Figure 4:
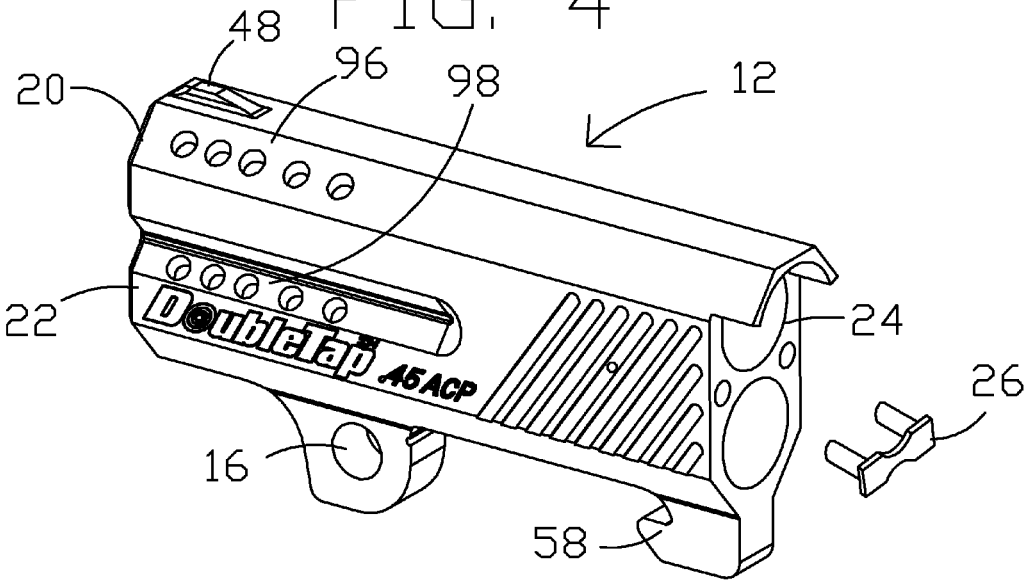
FIG. 4 is a perspective view of the barrel assembly of the pistol of the preferred embodiment of the present invention.

In accordance with the present invention a small, lightweight, two shot pistol 10 is shown in FIGS. 1-3 and 5-6. With specific reference to FIGS. 1, 5, and 6, the pistol 10 includes a removable barrel assembly or receiver 12 which can be pivoted about an axis defined by a retaining member 14 which is a pin held in place by a detent (not shown). The retaining member 14 extends through an opening 16 in the barrel assembly 12 (See, FIG. 4). It can be pushed from one side, to release it from the detent, whereby the barrel assembly 12 can be removed and replaced. A feature of the present invention is that interchangeable barrel assemblies can be used for different caliber cartridges.

Figure 1:
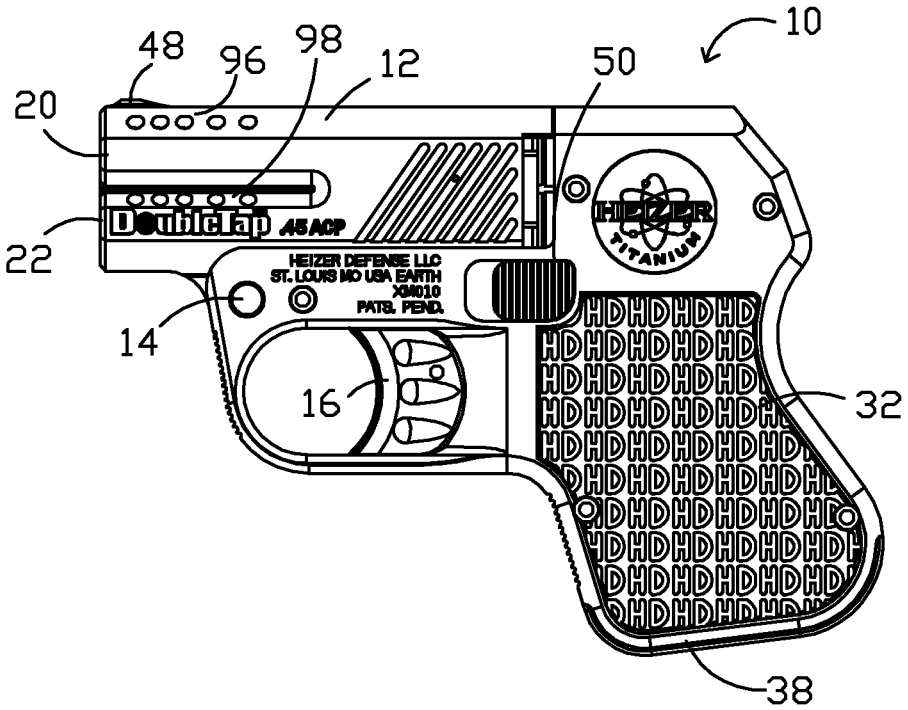
FIG. 1 is a side view of the pistol of the preferred embodiment of the present invention.
Figure 2:
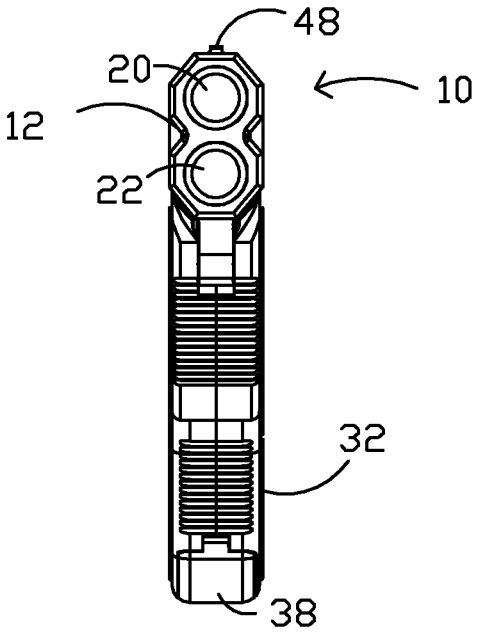
FIG. 2 is a front view (e.g., a muzzle view) of the preferred embodiment of the pistol of the preferred embodiment of the present invention looking into the barrels.
Figure 3:
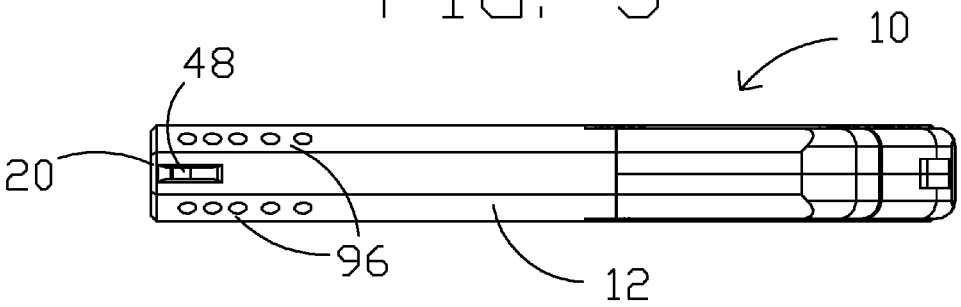
FIG. 3 is a top view of the pistol of the preferred embodiment of the present invention.
Figure 5:
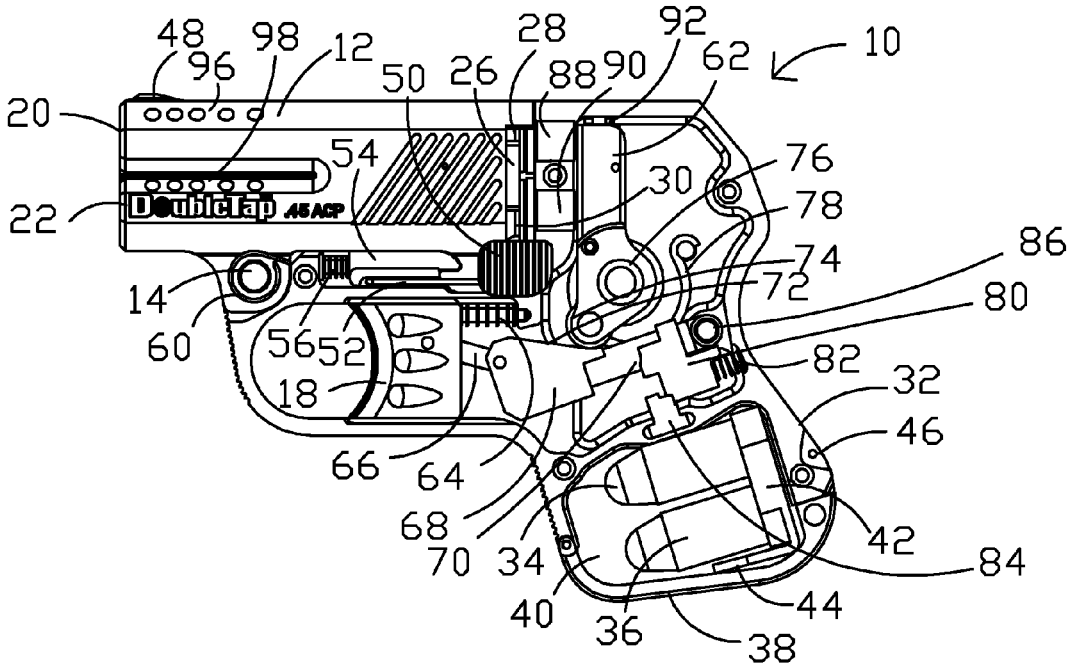
FIG. 5 is a side view cutaway view of the pistol of the preferred embodiment of the present invention.
Figure 6:
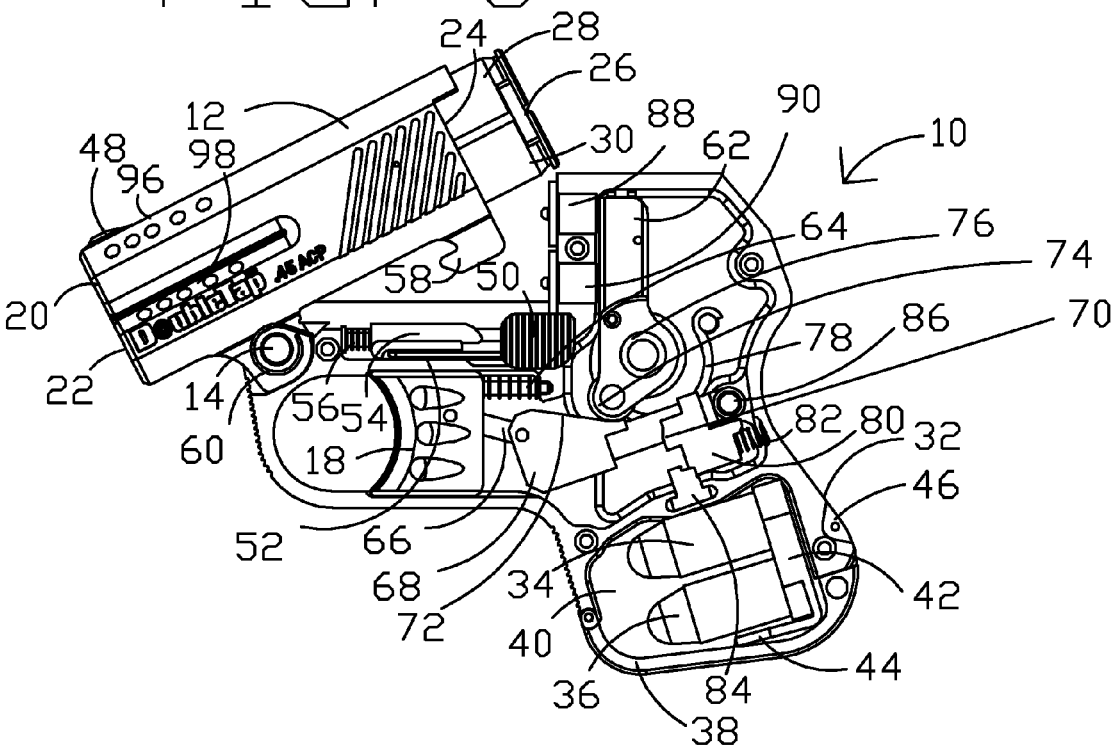
FIG. 6 is a side view cutaway view of the pistol of the preferred embodiment of the present invention with the barrel assembly in the raised position.

In accordance with the preferred embodiment of the invention, the pistol 10 includes a single trigger 18, which is preferably a double action trigger. The receiver 12 (shown in FIGS. 1-6) includes a pair of barrels which preferably have an over/under configuration, including an upper barrel 20 and a lower barrel 22, as best illustrated in FIG. 2. The breech 24 of the pistol 10 preferably includes a spring loaded auto-ejector 26 for receiving two cartridges 28, 30 which can be inserted therein when the receiver 12 is in its "tilted forward/open" position, as shown in FIG. 6.

The pistol 10 further includes a butt, or pistol grip 32 which is designed to receive a pair of spare cartridges 34, 36. In the preferred embodiment of the invention the pistol grip 32 is a machined integral grip, as it is machine processed to provide a pattern or design which emulates a texture, which may include designs or logos, as shown in FIG. 1, while being integral with the frame of the pistol 10 to minimize the thickness of the pistol 10. As shown in FIGS. 1-2 and 5-6, a trap door 38 is formed at the bottom of the grip 32. The trap door 38 pivots down from its normally closed position (shown) in order to allow the user to extract the spare cartridges 34, 36 from a cartridge trap 40 formed within the grip 32. As illustrated in FIGS. 5-6 the spare cartridges 34, 36 are press fit into a cartridge loading device 42 (the "Heizer loading device") which holds the cartridges 34, 36 in proper juxtaposition whereby they can be pressed directly into the breech 24 when the barrel assembly is tilted up as in FIG. 6. With continued reference to FIGS. 5 and 6 the cartridge loading device 42 includes a tab 44 which is bent over, as shown, when the cartridge loading device 42 is within the cartridge trap 40.

In the preferred embodiment of the invention a lanyard mount 46 is preferably included on the rear portion of the grip 32, whereby the pistol 10 may be retained by a lanyard or chain, as desired by the user.

Various features of the pistol 10 of the preferred embodiment of the invention are included in order to minimize any likelihood of catching or snagging as the user withdraws the pistol 10 from his pocket or other clothing. Thus, with continued reference to FIGS. 1-6, the pistol 10 includes an integrated, low profile sight 48, which may be comprised of a tritium sight. Another feature which prevents the pistol 10 from catching on a user's clothing is that it uses an internal hammer 62, which will be further described hereinafter, and which is fully enclosed within the frame of the pistol 10.

In accordance with the preferred embodiment of the invention, ambidextrous thumb latches 50 (See, FIGS. 1, 5, and 6) are included on each side of the pistol 10. While only the latch 50 on the left side of the pistol 10 is actually shown, the latch on the right side of the pistol 10 is identical. The design of the thumb latches 50, along with their associated mechanisms, is such that if either of them is pushed forward (toward the muzzle of the pistol 10) it will cause a receiver disconnect push pin 52 to push a receiver lockup pin 54 forward against the force of a latch retainer spring 56, thereby causing the lockup pin 54 to disengage from a barrel latch 58 formed on the underside of the barrel assembly 12 (See, FIG. 6). When the receiver lockup pin 54 is disengaged from the barrel latch 58 a barrel tip up spring 60 causes the barrel assembly 12 to rapidly tip up, as shown in FIG. 6.

When the rear of the barrel assembly 12 tips up, the spring-loaded ejector 26 forces the cartridges 28, 30 out of the breech 24 as soon as the breech 24 clears the frame. The user can then open the trap door 38 (which is held closed by a detent) and remove the cartridge loading device 42, which retains the spare cartridges 34, 36, from the cartridge trap 40 within the grip 32. While holding the tab 44, the user can quickly reload the pistol 10, tear the cartridge loading device 42 from the newly loaded cartridges 34, 36, and snap the barrel assembly 12 into its down, locked, and ready position.

As set forth above, another feature of the pistol 10 of the preferred invention is that it is designed to have an internal hammer 62 along with a smoothly joined exterior configuration whereby the likelihood of something on the pistol 10 "catching" when the pistol 10 is removed from a concealed location, e.g., from a user's pocket, is greatly reduced. With reference to FIGS. 5 and 6, the operation of the trigger 18 and associated mechanism is that when the trigger 18 is "pulled" against the force of the trigger spring 64, a trigger linkage 66 moves a sear 68 rearward along a sear guide 70 on which the sear 68 rides. The upper portion of the sear 68 presents a cam surface 72 to the pivoting hammer mechanism 62, whereby a roller bearing 74 rides up the cam surface 72, pivoting the hammer 62 rearward around a roller bearing 76 against the force of a hammer spring 78. When the sear 68 reaches a disconnect 80, the disconnect 80 is pushed rearward against the force of a disconnect spring 82 until it reaches a point where the disconnect 80 is pushed free of a disconnect block 84, at which point the sear guide 70 pivots downward about a disconnect pivot 86, clearing the roller bearing 76, and allowing the hammer 62 to be driven against firing pin assemblies 88, 90, each of which includes a firing pin which is spring loaded away from the breech until struck by the hammer 62, at which time a struck firing pin will be driven forward into a cartridge in the breech 24. In FIG. 6 the tips of the firing pins are shown extending out of the firing spring assemblies 88, 90 for clarity. However, the springs (not shown) within the firing spring assemblies 88, 90 would normally prevent the firing pin tips from extending, as they are strong enough to hold the hammer 62 somewhat back from the firing spring assemblies 88, 90.

While it is possible to have a single forward movement of the hammer 62 drive the firing pins in each of the firing pin assemblies 88, 90 into the cartridges 28, 30, in the preferred embodiment of the invention the hammer 62 has a cylindrical bore formed therein and a firing pin selector, in the shape of a cylinder is positioned within the cylindrical bore. The firing pin selector of the preferred embodiment of the invention (not shown) includes four faces, two of which have a flat portion in juxtaposition with the upper firing pin assembly 88, and two of which have a flat portion in juxtaposition with the lower firing pin assembly 90. On each of the faces of the firing pin selector, there is also a convex portion which prevents the firing pin selector from contacting the firing pin assembly 88 or 90 which is not to be struck. Firing pin indexes 92 on the firing pin selector cause the firing pin selector to rotate a quarter of a turn when they engage a yoke (not shown) each time the hammer 62 is brought back to fire the pistol 10. Thus, on each successive pull of the trigger 16, the firing pin in either the top firing pin assembly 88 or the firing pin in the bottom firing pin assembly 90, will be struck, but both will not be struck at the same time.

The use of the so-called roller bearing trigger system (so named because of the use of multiple roller bearings 74, 76) causes the trigger action to be extremely smooth.

Further features found in the preferred embodiment of the invention, which are designed to provide both strength and light weight to the pistol 10, are that the grip 32 is preferably made of a lightweight material, such as aluminum or titanium, while the barrels 20, 22 are preferably made of 416 stainless steel, as are the hammer 62 and other internal components. Titanium or aluminum alloy are preferably used to make the frame, with aluminum alloy being lighter and titanium being stronger without adding undue weight to the pistol 10.

A safety feature of the pistol 10 is that there is a space between the rear and the firing pin assemblies 88, 90 which provides a positive visual indication of whether the chamber is loaded as the rear of the cartridges are visually exposed.

As will be understood by those skilled in the art, many shooters consider the shape and size of the original and subsequent "1911" platform to be ergonomically preferred (so-called "1911 ergonomics"). Thus, the grip in the preferred embodiment of the invention angles back (from the vertical) by 17 degrees, the distance from the rear of the grip 32 (called the "back strap") to the front of the trigger 18, and the size and shape of the trigger 18 are in accordance with such 1911 ergonomics.

Yet, another feature of the preferred embodiment is that it uses progressively ported barrels which include a series of specifically designed gas venting holes 96, 98 in the barrels 20, 22. The purpose of the venting holes 96, 98 is that when the pistol 10 is discharged pressurized gases are diverted in specific directions and angles to reduce both recoil and muzzle climb.

As set forth above, the pistol 10 of the preferred embodiment includes a pivoting retaining member 14 which is used to attach the receiver 12 to the pistol 10. In the preferred embodiment of the invention, the pivoting retaining member 14, which may be in the form of a movable pin, or other suitable form allows the pistol to utilize interchangeable receivers 12, whereby the superposed double barrel receiver 12 is interchangeable to multiple calibers utilizing the same frame. By way of example, receivers including barrels for available calibers could include .22 caliber, 22 mag, 22hornet, 5.7.times.28 mm, 0.25 mm, .380, 9 mm, 10 mm, .40 S&W, .38 Special, .357 Magnum, .410, 45 ACP, 45 Long Colt, 44 Magnum, 50 S&W Magnum, or such other calibers as may be available or desired without departing from the present invention.

While the preferred embodiment of the invention has been described and illustrated, those skilled in the art will recognize that numerous variations of the present invention can be made without departing from the spirit of scope of the invention described and claimed. By way of one example, while the preferred embodiment has a sear assembly which uses a drop block and disconnect rest in combination with the cam surface and guide, alternative arrangements of the cam surface and guide are possible. Thus, it would be within the scope of the invention to have a cam surface and guide in other orientations with different drop block and disconnect rest designs or even a cam surface that moves relative to a guide without having any drop block or disconnect rest.

What is claimed is:

1. A trigger mechanism for a firearm, comprising:

a trigger pull;

a hammer having a striking end, a bearing end and a pivot point between said striking end and said bearing end, said striking end of said hammer having a striking position and a rearward position;

a sear comprising a cam surface and a guide, wherein said cam surface has a length extending from a first end to a second end, wherein said bearing end of said hammer engages said cam surface along said length from said first end to said second end as said cam surface is moved relative to said guide from a first position to a second position and pivots said hammer around said pivot point, and wherein said striking end is moved from said striking position to said rearward position as said cam surface moves from said first position to said second position and said hammer pivots around said pivot point;

a linkage having a trigger end pivotally connected to said trigger pull and a sear end in contact with said sear, wherein said linkage rotates as said trigger pull is forced rearward and moves said cam surface from said first position to said second position; and a hammer spring having a fixed end and a moving end connected to said hammer providing a hammer spring force, wherein said hammer spring biases said striking end of said hammer to said striking position and wherein said movement of said hammer from said striking position to said rearward position is performed against said hammer spring force.

2. The trigger mechanism of claim 1, wherein said cam surface has an incline angle relative to said bearing end of said hammer, wherein said engagement of hammer to said cam surface is further comprised of said bearing end riding up on said incline angle and forces a rotation of said bearing end and said striking end of said hammer around said pivot point.

3. The trigger mechanism of claim 1, wherein said pivot point is a roller bearing.

4. The trigger mechanism of claim 1, wherein said striking end has a distal end and a first distance between said pivot point and said distal end is greater than at least twice a second distance between said pivot point and said bearing end contacting said cam surface.

5. The trigger mechanism of claim 1, wherein said sear is further comprised of a rest configuration, a break point configuration and a disconnect configuration.

6. The trigger mechanism of claim 5, wherein said cam surface in said sear is comprised of a block assembly and wherein said guide in said sear is comprised of a guide rod, wherein said guide rod has a pivoting end and a rotating distal end, wherein said block assembly is positioned on said guide rod toward said distal end in said rest configuration and translates on said guide rod toward said pivoting end to said break point configuration, wherein said block assembly has a hammer cam surface side and a support side forming a wedge between said bearing end of said hammer and said face of said disconnect rest, said wedge forcing said bearing end of said hammer to rotate as said block assembly translates on said guide rod and thereby rotating said striking end of said hammer around said pivot point from said striking position to said rearward position, wherein said support side of said wedge comprises an edge positioned proximate to a ledge when said sear assembly is in said break point configuration, and wherein said hammer spring forces said sear assembly into said disconnect configuration while forcing said hammer from said cocked position to said striking position as said edge moves past said ledge.

7. The trigger mechanism of claim 1, further comprising a trigger spring and a firearm frame, wherein said trigger spring has a trigger spring force and a proximal end of said trigger spring is positioned against said firearm frame and a distal end of said trigger spring extends away from said firearm frame and engages said trigger pull, and wherein said guide is rotatably connected to said frame.

8. A trigger mechanism for a firearm, comprising:

a hammer having a first end, a second end and a pivot point between said first end and said second end, said first end of said hammer having a seated position and a cocked position;

a hammer spring biasing said first end of said hammer in said seated position;

a disconnect rest having a face, a sidewall and a ledge between said face and said sidewall;

a sear assembly having a rest configuration, a break point configuration and a disconnect configuration, wherein said sear assembly comprises a block assembly and a guide rod, wherein said guide rod has a pivoting end and a rotating distal end, wherein said block assembly is positioned on said guide rod toward said distal end in said rest configuration and translates on said guide rod toward said pivoting end to said break point configuration, wherein said block assembly has a hammer side and a support side forming a wedge between said second end of said hammer and said face of said disconnect rest, said wedge forcing said second end of said hammer to rotate as said block assembly translates on said guide rod and thereby rotating said first end of said hammer around said pivot point from said seated position to said cocked position, wherein said support side of said wedge comprises an edge positioned proximate to said ledge when said sear assembly is in said break point configuration, and wherein said hammer spring forces said sear assembly into said disconnect configuration while forcing said hammer from said cocked position to said seated position as said edge moves past said ledge.

9. The invention of claim 8, wherein said block assembly is selected from the group of assemblies consisting of a unitary disconnect wedge block and a wedge block separate from a disconnect block.

10. The invention of claim 8, wherein said wedge is generally arranged at an acute angle relative to a guide plane defined by a rotational axis of said pivoting end of said guide rod and a longitudinal axis between said pivoting end and said distal end of said guide rod.

11. The invention of claim 8 further comprising a trigger pull and an arm connecting said trigger pull to said sear assembly through a pair of rotating joints at opposite ends of said arm, wherein said trigger pull further comprises a trigger return spring and said sear assembly further comprises a sear return spring, and wherein said trigger return spring and said sear return spring respectively bias said trigger pull and said sear assembly in said rest position.

12. A trigger mechanism for a firearm comprising:

a frame, said frame including a grip;

a barrel connected to said frame; and a trigger assembly, said trigger assembly comprising a trigger operatively connected to said grip, said trigger assembly further including at least one firing pin, and a linkage to a sear comprising a cam surface and a guide, wherein said cam surface has a length extending from a first end to a second end, wherein a bearing end of said internal hammer engages said cam surface along said length from said first end to said second end as said cam surface is moved relative to said guide from a first position to a second position and pivots said internal hammer around a pivot point, and wherein a striking end of said internal hammer is moved from a striking position to a rearward position as said cam surface moves from said first position said second position and said internal hammer pivots around said pivot point.

13. The multi-shot pistol of claim 12, wherein said linkage further comprises a trigger end pivotally connected to said single trigger and a sear end in contact with said sear.

14. The multi-shot pistol of claim 13, wherein said linkage rotates as said single trigger is forced rearward and moves said cam surface from said first position to said second position.

15. The multi-shot pistol of claim 14, further comprising a hammer spring having a fixed end and a moving end connected to said internal hammer providing a hammer spring force, wherein said hammer spring biases said striking end of said internal hammer to said striking position and wherein said movement of said internal hammer from said striking position to said rearward position is performed against said hammer spring force.

16. The multi-shot pistol of claim 15, wherein said cam surface has an incline angle relative to said bearing end of said internal hammer, wherein said engagement of said internal hammer to said cam surface is further comprised of said bearing end riding up on said incline angle and forcing a rotation of said bearing end and said striking end of said internal hammer around said pivot point.

17. The trigger mechanism of claim 13, wherein said pivot point is a roller bearing.

18. The trigger mechanism of claim 13, wherein said sear is further comprised of a rest configuration, a break point configuration and a disconnect configuration.

19. The trigger mechanism of claim 13, wherein said cam surface in said sear is comprised of a block assembly and wherein said guide in said sear is comprised of a guide rod, wherein said guide rod has a pivoting end and a rotating distal end, wherein said block assembly is positioned on said guide rod toward said distal end in said rest configuration and translates on said guide rod toward said pivoting end to said break point configuration, wherein said block assembly has a hammer cam surface side and a support side forming a wedge between said bearing end of said hammer and said face of said disconnect rest, said wedge forcing said bearing end of said hammer to rotate as said block assembly translates on said guide rod and thereby rotating said striking end of said hammer around said pivot point from said striking position to said rearward position, wherein said support side of said wedge comprises an edge positioned proximate to a ledge when said sear assembly is in said break point configuration, and wherein said hammer spring forces said sear assembly into said disconnect configuration while forcing said hammer from said cocked position to said striking position as said edge moves past said ledge.

20. The trigger mechanism of claim 19, wherein said pivot point is a roller bearing.

* * * * *